US009651326B2

(12) United States Patent
Weilharter

(10) Patent No.: US 9,651,326 B2
(45) Date of Patent: May 16, 2017

(54) FIREARM

(71) Applicant: Rene Weilharter, Ybbs an der Donau (AT)

(72) Inventor: Rene Weilharter, Ybbs an der Donau (AT)

( * ) Notice: Subject to any disclaimer, the term of this patent is extended or adjusted under 35 U.S.C. 154(b) by 0 days.

(21) Appl. No.: 14/893,241

(22) PCT Filed: Jun. 27, 2014

(86) PCT No.: PCT/AT2014/050146
§ 371 (c)(1),
(2) Date: Nov. 23, 2015

(87) PCT Pub. No.: WO2014/205473
PCT Pub. Date: Dec. 31, 2014

(65) Prior Publication Data

US 2016/0109202 A1 Apr. 21, 2016

(30) Foreign Application Priority Data

Jun. 27, 2013 (AT) ..... A 50423/2013

(51) Int. Cl.
*F41A 17/36* (2006.01)
*F41A 17/34* (2006.01)
(Continued)

(52) U.S. Cl.
CPC ..... *F41A 17/36* (2013.01); *F41A 9/64* (2013.01); *F41A 17/34* (2013.01); *F41A 23/18* (2013.01)

(58) Field of Classification Search
CPC .. F41A 17/34–17/36; F41A 9/64; F41A 23/18
See application file for complete search history.

(56) References Cited

U.S. PATENT DOCUMENTS 4,539,889 A 9/1985 Glock
4,664,015 A * 5/1987 Kennedy ..... F41A 9/59 89/138
(Continued)

FOREIGN PATENT DOCUMENTS

DE 3035796 A 5/1982
DE 19839985 A1 * 3/2000 ..... F41A 17/36
(Continued)

*Primary Examiner* — Stephen M Johnson
*Assistant Examiner* — Joshua Semick
(74) *Attorney, Agent, or Firm* — Andrew Wilford

(57) ABSTRACT

The invention relates to a firearm comprising a housing (1), a magazine (2) for cartridges (3) which are preloaded in the direction of a transfer opening by means of a magazine feeder (7), a lock (8) which can be moved relative to the housing (1) in order to convey the cartridges (3), and a lock catch lever (4) which holds the lock (8) in a rear position when the magazine (2) is empty. A trigger element (9) is provided for automatically releasing the lock (8) into the front position when a loaded magazine (2) is inserted. An engagement surface (10) of the trigger element (9) protrudes into the movement path of a control surface (11) of the magazine (2) in a front starting position. The trigger element (9) is coupled to the lock (8) in a kinematic manner via an effective surface (12) at least during a part of the movement when moving from the front starting position into a rear end position. At the end of the coupled part of the movement, the lock (8) is offset towards the rear relative to the lock rear position by another portion along the lock movement path. The effective surface (12) of the trigger element (9) is disengaged again from the lock (8) in the rear end position of the trigger element (9).

8 Claims, 2 Drawing Sheets

(51) Int. Cl.
*F41A 9/64* (2006.01)
*F41A 23/18* (2006.01)

(56) References Cited

U.S. PATENT DOCUMENTS

| | | | | | |
|---|---|---|---|---|---|
| 4,825,744 | A | | 5/1989 | Glock | |
| 4,893,546 | A | | 1/1990 | Glock | |
| 5,131,317 | A | * | 7/1992 | Meller | F41A 17/36 89/138 |
| 2016/0069627 | A1 | * | 3/2016 | Cobb | F41A 17/40 42/70.02 |

FOREIGN PATENT DOCUMENTS

| | | | | | |
|---|---|---|---|---|---|
| DE | 102006005351 | A | | 8/2007 | |
| FR | 648817 | B | | 8/1928 | |
| GB | 151196 | A | | 9/1920 | |
| GB | 215680 | A | * | 5/1924 | F41A 9/59 |

* cited by examiner

Fig. 1 - Prior Art
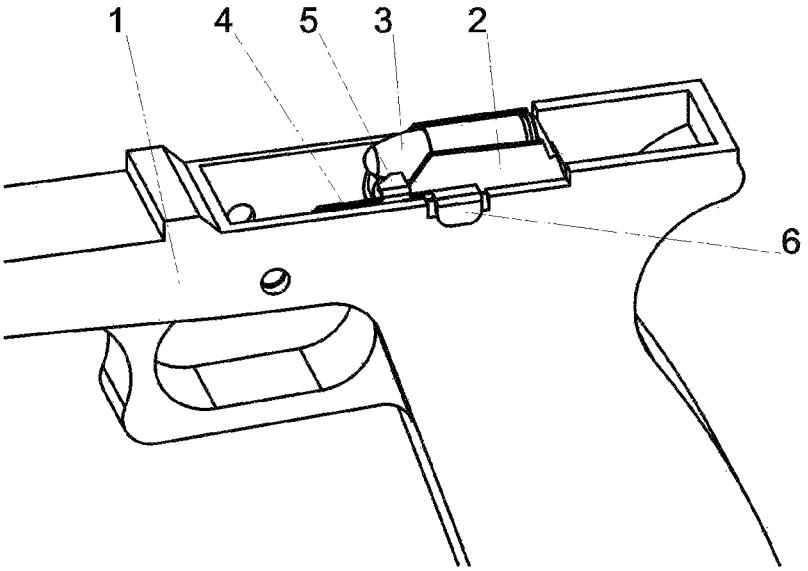
Fig. 2 - Prior Art
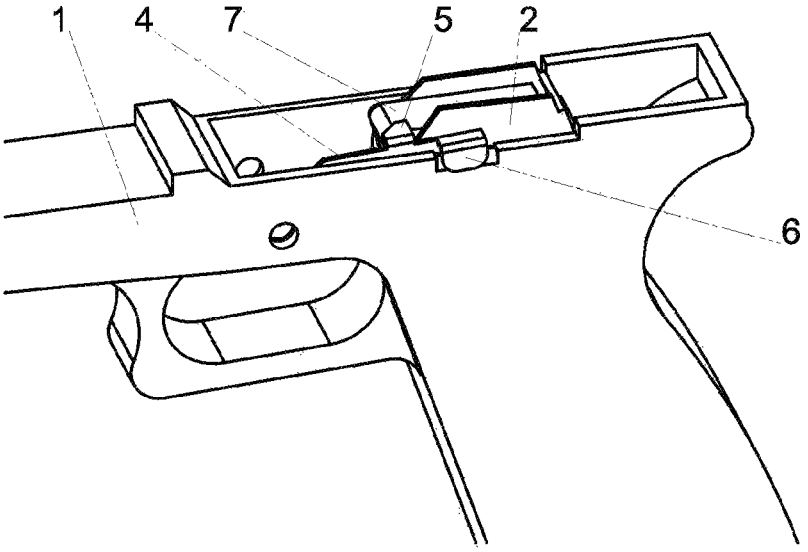

FIREARM

CROSS REFERENCE TO RELATED APPLICATIONS

This application is the US-national stage of PCT application PCT/AT2014/050146 filed 27 Jun. 2014 and claiming the priority of Austrian patent application A 50423/2013 itself filed 27 Jun. 2013.

FIELD OF THE INVENTION

The invention relates to a firearm comprising a frame, a magazine that can be inserted into a well of the frame cartridges in the magazine being biased by a follower toward an open magazine end, a slide that moveable relative to the frame to move cartridges from the open end of the magazine into a breech in the frame or to move cartridge casings from the breech to an ejection window, and a slide catch lever that is pivotal or slidable on the frame and that holds the slide in a rear retracted position by interaction with the follower when the magazine is empty.

BACKGROUND OF THE INVENTION

Firearms currently in use for example by special forces around the world function as follows. When a cartridge is fired, the recoil or the gas pressure retracts the slide—also called the breech block or the locking piece. The extractor (also called an extractor claw) that is attached to the slide extracts the empty casing from the breech by a groove intended for this purpose.

During further rearward travel the empty casing held by the retractor strikes the ejector that is typically attached to the grip of the pistol. As a result, the casing is usually ejected laterally upward through the ejection window of the slide, while the slide continues to travel rearward and cocks any striker piece present there or a firing pin (also called a hammer or cocking means), thereby creating readiness to fire.

Once it has reached its rear retracted position the recoil spring (also called a closing spring or feed spring) then returns the slide forward. The slide at the same time feeds a new cartridge from the magazine to the breech. Once in the forward closed position, the new cartridge is in the breech, and the striker piece or firing pin is cocked and the weapon ready to fire. The shooter then only has to release and then pull the trigger for the next shot.

Once the magazine has been emptied by firing the weapon, the follower presses on the slide catch lever that engages a corresponding cutout of the slide and holds the slide in place in the rear retracted position. After the magazine has been changed, the slide catch lever must be unlocked often by exerting a strong amount of force, the slide catch lever being under a relatively high load applied by the recoil spring. This procedure can become a difficult task with gloves, sweaty hands, or the tremendous stress in an active situation, and this difficulty can in the worst case result in the death of the force team member.

Various approaches currently exist that are intended to facilitate or attempt to circumvent this high-force unlocking procedure. Raised areas—known as thumb rests or textures—are provided, for example, on the slide catch lever in order to increase friction and thus prevent a finger from sliding off during the unlocking procedure. The manipulation technique known as the "double hand release" tries to address this problem whereby the slide catch lever is operated by the thumb of the other hand since this enables more pressure to be applied to the slide catch lever.

Another possible approach consists in modifying the manipulation of the weapon in order to unlock the slide after insertion of a new magazine and to circumvent operating the slide catch lever—for example, the so-called "overhand release" or "sling shot" in which the slide is moved by the other hand manually further rearward into the retracted position so as to reduce pressure on the slide catch lever, as a result of which this lever is moved by the return spring back to the release position.

However the previous procedures demand comprehensive training of the user in order to be able to perform "blindly" in an emergency situation. This cannot be assumed for a force team member for whom there is a high probability that he/she was never previously involved in an exchange of gunfire.

OBJECT OF THE INVENTION

The object of the invention is therefore to improve a firearm so to eliminate the above-referenced problem and to provide automatic release of the slide and the return movement to the closed front end position when a new magazine is inserted. At the same time the solution to the problem should be achieved as simply and cost-effectively as possible in order to keep weapon production costs low.

SUMMARY OF THE INVENTION

This object is achieved according to the invention by an approach whereby a release element is provided to automatically release the slide into the closed front end position when a new loaded magazine is inserted, an actuating formation of the release element projecting into the magazine well in a front end position into a path of motion of a control surface of the magazine and being engageable in this magazine well when the magazine is inserted, and that furthermore the release element is kinematically coupled through a catch face to the slide at least for a segment of motion during movement from the front end position into a rear end position, the slide at the end of the coupled segment of motion being shifted rearward relative to its rear retracted position by a further segment along its path of motion such that the slide catch lever is freed and furthermore the catch face of the release element in the rear end position thereof is again disengaged from the slide.

The invention enables the slide, which is secured in the rear position when the magazine has been emptied by firing the weapon, to again be automatically unlocked when a new full magazine is inserted, and allows readiness to fire to be restored. This saves time and increases safety for the user. The normal functioning of the slide catch lever is not negatively affected thereby. The slide can again be secured in the rear position for the weapon to be transferred or checked (manually or once the magazine has been emptied by firing the weapon). The slide is freed only when a new full magazine has been inserted but not when the old magazine is removed or an empty magazine is inserted.

The invention can therefore be implemented by the addition of only a single component. The slide is pushed back a little when the magazine is inserted, and thus the same motion is performed as that which must be performed normally by manually retracting the slide with the other hand ("overhand release").

One possible and easily implemented embodiment of the invention provides an approach whereby the release element is a movable small plate that is mounted on the frame and is provided with at least one control pin.

A further feature of the invention is that a guide slot has a clearance or a corresponding alternative track segment and the small plate on the slide can be moved past the slide into the front end position thereof when the magazine is ejected. In terms of an especially simple and thus cost-effective variant, a feature according to the invention is the fact that the guide slot is a slot that extends essentially parallel to the slide direction.

When the magazine is removed, the release element must be moved past the slide in order to return to the front end position. To this end a certain clearance in the guide slot or an alternative track segment is provided. It is obvious to the average person skilled in the art that the control surfaces and actuating formations, and/or the guide slot and the control pin can be on the respective other component (magazine or release element, or release element or frame) in both embodiments.

According to another feature of the invention, the release element is biased forward by a spring to ensure the functional reliability of the firearm in any position.

According to another feature of the invention, the control surface of the magazine is a top edge or a lateral projection of the magazine housing. Using already existing magazine edges and projections as the control surface means that the magazines already on the market of a given weapon type do not have to be modified and can continue to be used, thereby enhancing the economic viability of the invention.

A final feature of the invention is that the actuating formation of the release element is simultaneously the end stop of the magazine in the magazine well. The release element and the other interacting surfaces must be matched in such a way according to the weapon type that the magazine is locked the moment the slide also freed. This is especially easy to implement if the actuating formation of the release element simultaneously forms the end stop of the magazine.

BRIEF DESCRIPTION OF THE DRAWING

The following describes the invention in more detail based on the attached drawing in which FIG. 1 is a schematic perspective view of a prior-art firearm with an inserted magazine and cartridges, the slide not being shown for purposes of greater clarity;

FIG. 2 shows the firearm of FIG. 1 after the magazine has been emptied by firing the weapon;

SPECIFIC DESCRIPTION OF THE INVENTION

Figure 3:
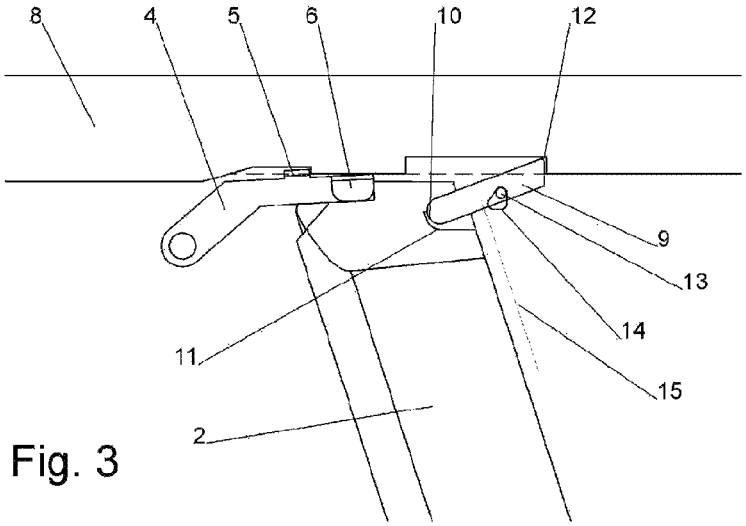
FIG. 3 is a schematic detailed sectional view through an embodiment of a firearm according to the invention when a new magazine is inserted.

The firearm shown in FIGS. 1 and 2 is based on the prior art and comprises a frame 1 in which a magazine 2 holding cartridges 3 can be inserted. A slide, not shown, can move relative to the frame 1 on the top of the weapon and moves cartridges 3 into the breech and moves cartridge casings out an ejector window. The slide is biased by a recoil spring toward the forward closed position and is moved back against the force of the recoil spring by blowback when the weapon is fired. As soon as the last cartridge 3 is fired from the magazine 2, the slide moves back and a top edge of the follower 7 presses a slide catch lever 4 upward by upward engagement with a projection 5 on the slide catch lever 4 (see FIG. 2). The illustrated embodiment has been implemented in this way, for example, in a Glock®. The slide catch lever 4 in the case of other manufacturers is operated, for example, laterally on the magazine.

As a result, the slide catch lever 4 at the same time fits into a cutout of the here unillustrated slide and holds the slide in place in the rear retracted position. Once the magazine 2 has been replaced, the slide catch lever 4 must be freed to move the slide back to the forward closed position. This can be effected, for example, by pressing down the slide catch lever 4 by means of an operating formation 6. Less force needs to be applied to release the slide catch lever 4 by the operating formation 6 since the force of the recoil spring acts on the slide and thus on the slide catch lever 4 as well. Using an alternative method the user can pull the slide back with the other hand a bit further, with the result that the force bearing on the slide catch lever 4 is removed and the lever 4 is moved back to the release position by a separate here unillustrated return spring of the lever 4. Both methods require force and/or practice on the part of the user and are difficult to perform during an emergency situation.

Figure 4:
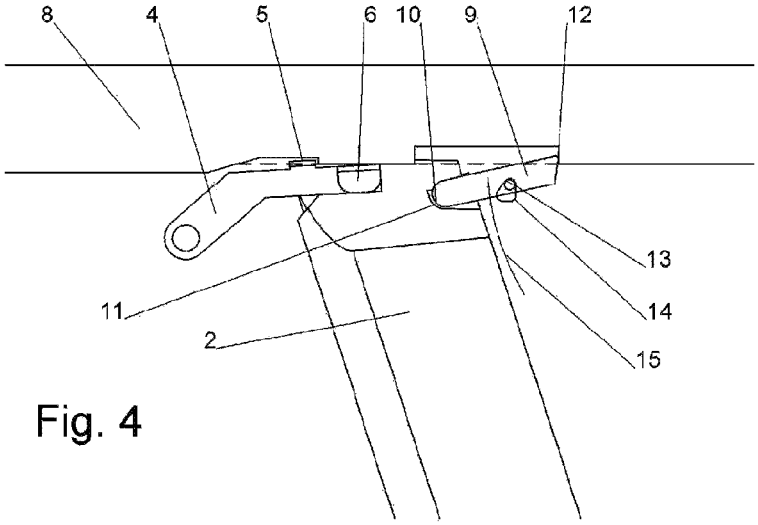
FIG. 4 shows the firearm of FIG. 3 with the magazine almost completely inserted.
Figure 5:
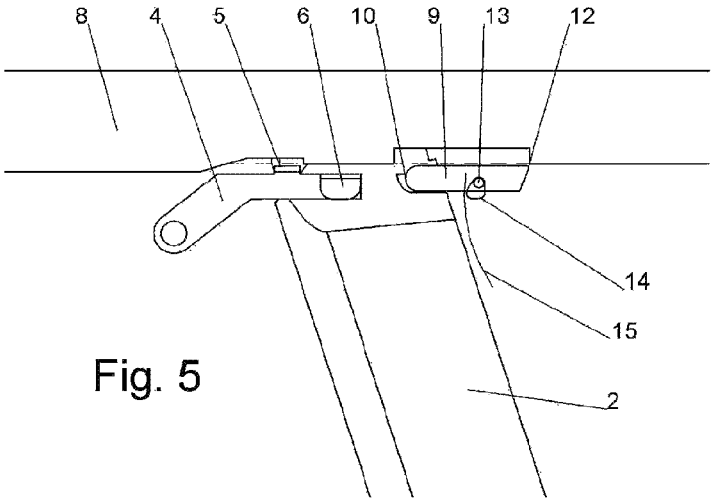
FIG. 5 shows the firearm of FIG. 3 with the magazine completely inserted.

FIGS. 3 through 5 schematically illustrate changing a magazine in a firearm according to the invention. In addition to the components already described in FIGS. 1 and 2, a release element 9 is provided that is a small plate moveable by a control pin 13 in a guide slot 14. The release element 9 has an actuating formation 10 that interacts with a corresponding control surface 11 on the magazine 2. FIG. 3 shows the situation when a new magazine 2 is inserted and immediately before the actuating formation 10 contacts the control surface 11. The slide 8 is secured in the rear retracted position by the slide catch lever 4.

Once the magazine 2 has been emptied by firing the weapon, the follower presses the slide catch lever 4 back upward (FIG. 5). When the magazine 2 is ejected, the actuating formation 10, slides past a second control section of the control surface 11. The release element 9 is lifted slightly at the same time, and a catch face 12 disengages from the slide catch lever 4. The normal safety function of the slide catch lever 4 is thus not impaired by the release element 9.

When the magazine 2 is inserted further (FIG. 4), the face 12 of the release element 9 is pressed against the slide 8 by the control surface 11. This relieves the force on the slide catch lever 4 because the slide 8 is moved back yet a bit further. As a result, the force on the slide catch lever 4 is relieved and it can be moved back by its return spring to the release position thereof. Once the magazine has been inserted completely (FIG. 5), the release element 9 clears the slide 8 and the slide can return to the forward closed position.

Although the slide 8 is freed by the release element 9 when an empty magazine is inserted, the slide catch lever 4 nevertheless catches the slide 8 simultaneously since the latter is again pressed upward by the follower 7. As a result, the invention automatically differentiates between an empty magazine and a full magazine, thereby preventing the in practice normal safety aspect of the open slide from being impaired by unintentionally closing the slide with an empty magazine.

The catch face 12 must be able to move past the slide 8 when the magazine 2 is ejected so as to allow the release element 9 to return to its starting position. The return motion is effected by a spring 15. Clearance is provided in the guide slot 14 so as to prevent the release element 9 from getting caught on the slide 8.

The embodiment of FIGS. 3 through 5 thus in principle imitates the motion that the user normally performs with the other hand when retracting the slide 8 in order to release the slide catch lever 4. However, this occurs simultaneously with changing the magazine, which step cannot be performed by hand.

Automating the release of the slide catch lever 4 thus enables the useful readiness of the firearm to be restored more quickly without requiring the user to undergo extensive training or exert substantial force. At the same time safety is not impaired that is associated with the normal functioning of the slide catch lever.

The invention claimed is:

1. A firearm comprising:

a frame, a magazine that can be inserted into a magazine well of the frame, cartridges in the magazine being biased by a follower toward an open magazine end, a slide moveable relative to the frame to move cartridges from the open end of the magazine into a breech in the frame or to move cartridge casings from the breech to an ejection window, a slide catch lever pivotal or slidable on the frame and that holds the slide in a rear retracted position when engaged by the follower when the magazine is empty, a release element that automatically releases the slide into a closed front end position when a new loaded magazine is inserted, the release element having an actuating formation projecting into the magazine well and into a path of motion of a control surface of the magazine and being engageable in the magazine well by the control surface when the magazine is inserted, and a catch face on the release element kinematically coupled to the slide at least for a segment of motion of the slide from the front end position into a rear end position, the slide at the end of the coupled segment of motion being shifted rearward relative to its rear retracted position by a further segment along its path of motion such that the slide catch lever is freed and furthermore the catch face of the release element in the rear end position thereof is again disengaged from the slide.

2. The firearm according to claim 1, wherein the release element is a movable small plate that is mounted on the frame and is provided with at least one control pin that is guided in a guide slot formed in the frame.

3. The firearm according to claim 2, wherein the guide slot forms a clearance or a corresponding alternative track segment such that the small plate is decoupled from the slide during the entire segment of motion from the rear end position toward the front end position.

4. A firearm comprising:

a frame formed with a guide slot extending essentially parallel to a slide direction of travel, a magazine that can be inserted into a magazine well of the frame, a follower biasing cartridges in the magazine toward an open magazine end, a slide moveable relative to the frame to move cartridges from the open end of the magazine into a breech in the frame or to move cartridge casings from the breech to an ejection window, a slide catch lever pivotal or slidable on the frame and holding the slide in a rear retracted position by interaction with the follower when the magazine is empty, a movable small plate for automatically releasing the slide into a closed front end position when a new loaded magazine is inserted, the small plate having an actuating formation projecting into the magazine well in a front end position into a path of motion of a control surface of the magazine and being engageable in the magazine well when the magazine is inserted, the small plate having at least one control pin slidable in the guide slot of the frame, and a catch face kinematically coupling the small plate to the slide at least for a part of movement of the slide from the front end position into a rear end position, the slide at the end of such movement being shifted rearward relative to its rear end position by a further segment along its path of motion such that the slide catch lever is freed and furthermore the catch face of the small plate in the rear end position thereof is again disengaged from the slide.

5. The firearm according to claim 4, wherein the small plate is biased forwardly by a spring.

6. The firearm according to claim 4, wherein the control surface of the magazine is a top edge or a lateral projection of a magazine housing.

7. The firearm according to claim 4, wherein the actuating formation of the small plate is also an end stop of the magazine.

8. A firearm comprising:

a frame formed with a guide slot, a magazine that can be inserted into a magazine well of the frame, a follower biasing cartridges in the magazine toward an open magazine end, a slide moveable relative to the frame to move cartridges from the open end of the magazine into a breech in the frame or to move cartridge casings from the breech to an ejection window, a slide catch lever pivotal or slidable on the frame and holding the slide in a rear retracted position by interaction with the follower when the magazine is empty, a movable small plate for automatically releasing the slide into a closed front end position when a new loaded magazine is inserted, the small plate having an actuating formation projecting into the magazine well in a front end position into a path of motion of a control surface of the magazine and being engageable in the magazine well when the magazine is inserted, the small plate having at least one control pin slidable in the guide slot of the frame, and a catch face kinematically coupling the small plate to the slide at least for a part of movement of the slide from the front end position into a rear end position, the slide at the end of such movement being shifted rearward relative to its rear end position by a further segment along its path of motion such that the slide catch lever is freed and furthermore the catch face of the small plate in the rear end position thereof is again disengaged from the slide, the guide slot forming a clearance or a corresponding alternative track segment such that the small plate is decoupled from the slide during the entire movement from the rear end position toward the front end position.

* * * * *